United States Patent [19]

Stuller et al.

[11] 4,053,997

[45] Oct. 18, 1977

[54] SCRAPER ELEVATOR WITH LOWER DRIVE SPROCKETS

[75] Inventors: Howard E. Stuller; Glenn E. Walser, both of Lubbock, Tex.

[73] Assignee: Clark Equipment Company, Buchanan, Mich.

[21] Appl. No.: 407,694

[22] Filed: Oct. 18, 1973

Related U.S. Application Data

[63] Continuation of Ser. No. 167,764, July 30, 1971, abandoned.

[51] Int. Cl.[2] ..... E02F 1/00

[52] U.S. Cl. ..... 37/8; 198/854

[58] Field of Search ..... 37/8; 198/203, 135, 198/854

[56] References Cited

U.S. PATENT DOCUMENTS

| | | | |
|---|---|---|---|
| 2,464,098 | 3/1949 | Pittlick | 37/8 |
| 2,674,853 | 4/1954 | Born | 37/8 |
| 2,941,411 | 6/1960 | Wilhelm | 198/203 X |
| 3,331,149 | 7/1967 | Rapp | 37/8 |
| 3,360,107 | 12/1967 | Lockwood | 198/203 |
| 3,443,680 | 5/1969 | Brill | 198/203 |
| 3,483,639 | 12/1969 | Eftefield et al. | 37/8 |
| 3,543,915 | 12/1970 | Grossklaus | 37/8 X |
| 3,668,794 | 6/1972 | Marquardt et al. | 37/8 |
| 3,738,031 | 6/1973 | Lott | 37/8 |
| 3,744,164 | 7/1973 | Harrison | 37/8 X |

*Primary Examiner*—E. H. Eickholt
*Attorney, Agent, or Firm*—Kenneth C. Witt

[57] ABSTRACT

An elevator mechanism for an elevating scraper in which the sprockets which drive the elevator chains are located immediately adjacent the ground in the loading position.

13 Claims, 5 Drawing Figures

INVENTORS
HOWARD E. STULLER
GLENN E. WALSER
BY
Kenneth C. Witt
ATTORNEY

INVENTORS
HOWARD E. STULLER
GLENN E. WALSER
BY
Kenneth C. Witt
ATTORNEY

INVENTORS
HOWARD E. STULLER
GLENN E. WALSER
BY
Kenneth C. Witt
ATTORNEY

SCRAPER ELEVATOR WITH LOWER DRIVE SPROCKETS

This is a continuation of application Ser. No. 167,764, filed July 30, 1971, and now abandoned.

BACKGROUND OF THE INVENTION

1. Field of the Invention

This invention relates to the elevator mechanisms utilized on self-loading elevator type scrapers.

Such mechanisms generally comprise a substantial frame structure which supports the sprockets and idlers over which are trained two endless chains. Flights or slats are connected between the chains, and driving means such as a hydraulic motor, electric motor, a separate engine or a power takeoff from the main engine of the vehicle is provided to operate the endless chains.

During a loading operation, the lower end of the elevator is located adjacent the cutting edge of the scraper which is cutting through the soil. The flights engage the soil in sequence as the chains rotate, loosening the soil, after which the flights then assist in pushing the loosened soil back into the scraper bowl as the scraper moves forward.

2. Description of the Prior Art

Heretofore, elevators for elevating scrapers have been driven from the top, that is, the endless chains are trained over driving sprockets and the driving sprockets are located at the upper or remote end of the elevator mechanism from the ground.

Usually in prior elevators, the endless chains are trained over idlers or idler rollers which do not have teeth, which are located at the bottom of the elevator, and it is this bottom end of the elevator which is moved near to the cutting edge during a loading operation in order to cut into the soil and move it into the bowl in conjunction with the forward movement of the scraper.

In the operation of such an elevator mechanism, there are two principal forces which act upon the chains and associated parts. One is a shock load or transient force which occurs each time a flight strikes the earth. The other is a relatively steady force caused by the flights dragging dirt back into the scraper bowl, the magnitude of the latter force increasing as the bowl fills with dirt, making it necessary to move the dirt farther up and back to get it on top of the dirt already in the bowl. Both of these mentioned forces are subject to variations, but it is the transient or shock forces which cause the more severe stresses and are more deleterious to the elevator mechanism and which cause the most wear, particularly to the chains. Such forces also make it necessary to have a relatively heavy and strong frame structure when a conventional elevator drive is used, to aid in withstanding the transient forces and also aid in preventing wear of parts of the elevator mechanism such as the chains by avoiding undue distortion during operation.

SUMMARY OF THE INVENTION

We have discovered that it is possible to provide a lighter weight, less costly, but yet more efficient elevator loading mechanism for an elevating scraper by utilizing a driving mechanism in which the drive sprockets are located at the bottom of the elevator structure immediately adjacent the ground when the elevator mechanism is in the digging position.

DESCRIPTION OF THE PREFERRED EMBODIMENT

Figure 1:
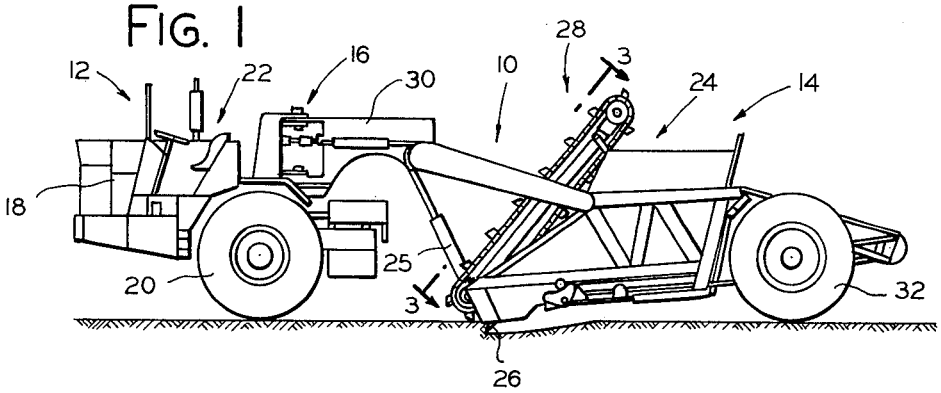
FIG. 1 is a side elevational view of an elevating scraper embodying the elevator mechansim of the present invention in a preferred mode thereof.

The numeral 10 in FIG. 1 designates generally a tractor elevating scraper which is illustrated in the form of an articulated vehicle comprising a two wheel tractor portion 12 and a two wheel trailer portion 14 connected by a combined steering and draft coupling indicated by the numeral 16. The tractor portion 12 includes an engine or other prime mover (not visible) within enclosure 18, a pair of wheels 20 (only one of which is shown) which are driven by the engine to propel the vehicle, and an operator's station 22.

This vehicle is for loading, transporting and unloading various kinds of soil and other material; and the trailer portion 14 includes a main bowl or box portion 24 having a cutting edge 26 at the lower front, and an endless chain elevator 28 for moving material upwardly and rearwardly into the bowl. The elevator 28 is operated counterclockwise as viewed in FIG. 1 for loading. During the loading operation, the cutting edge 26 is lowered into the ground as indicated in FIG. 1. Other parts of the trailer portion 14 include a yoke 30 for connecting the trailer portion to the tractor portion, and a pair of rubber tired wheels 32 (only one of which is visible) mounted at the outer ends of the rear axle.

Figure 2:
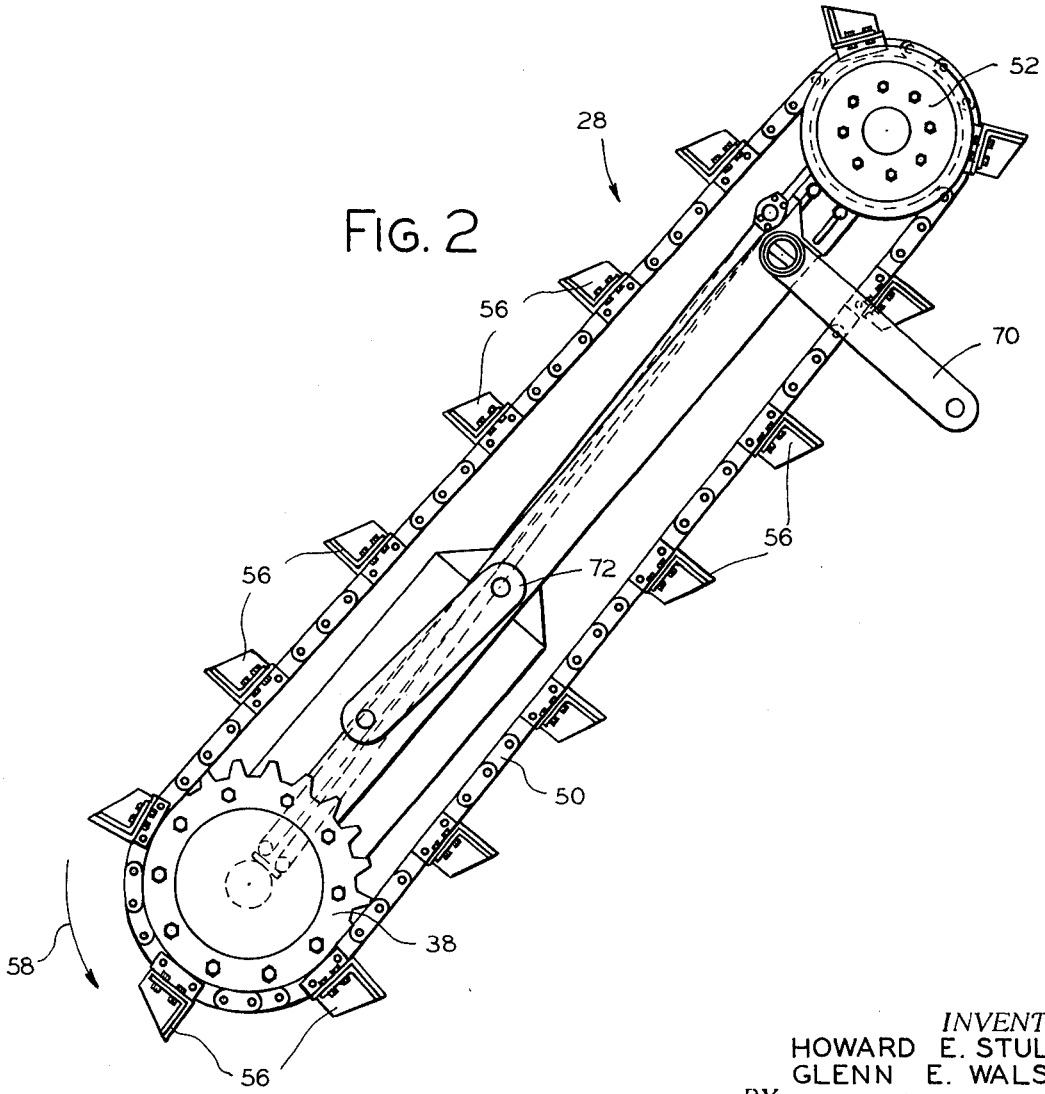
FIG. 2 is an enlarged view in side elevation of the elevator mechanism only.
Figure 3:
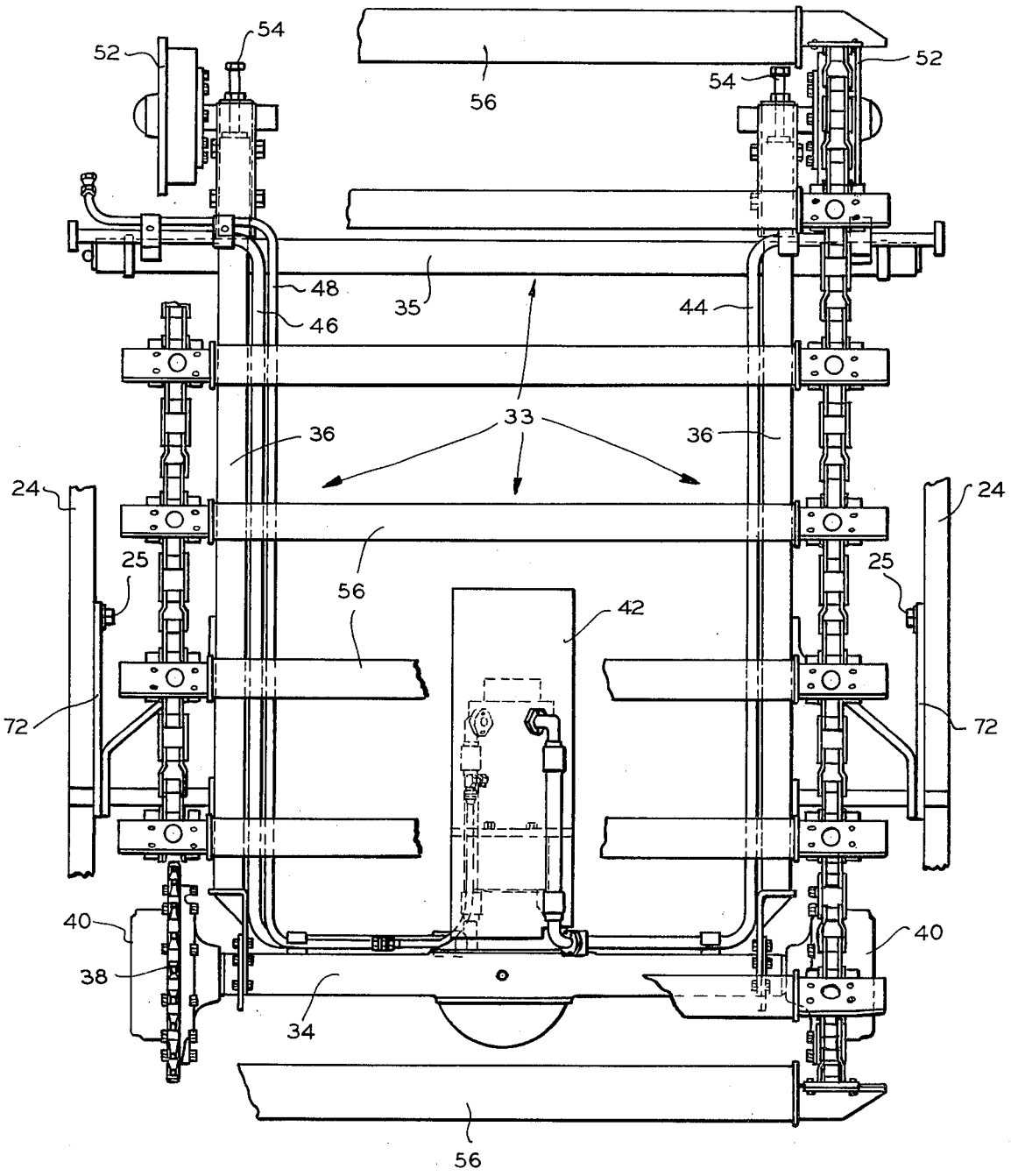
FIG. 3 is a view of the same elevator mechanism shown in FIG. 2 with some parts broken away, and taken along the lines 3—3 of FIG. 1.

Referring to FIGS. 2 and 3, the elevator mechanism 28 is shown in greater detail. As illustrated, it includes a rectangular frame structure 33 which includes a hollow structural member 34 comprising the bottom portion of the rectangle, upwardly disposed side frame members 36 which are rigidly connected at their lower ends to cross member 34, and a top cross member 35 also rigidly connected to the side members 36. There are a pair of drive sprockets 38 rotatably mounted adjacent the ends of member 34. In the mechanism illustrated, there is a longitudinal shaft extending through hollow member 34 which drives sprockets 38 in synchronism through planetary gear reduction mechanisms 40. The shaft within member 34 is driven by means of a bevel gear reduction mechanism by a hydraulic motor 42 which is rigidly mounted on cross member 34 to form a portion of the elevator mechanism.

Motor 42, for example, may be of the efficient, axial piston type with fixed displacement, but it may be operated by a variable displacement axial piston pump driven, for example, by the engine of the vehicle. With such an arrangement it is possible to secure an infinite variation of the motor speed and hence of the chain speed on the elevator from zero to the maximum which might be, for example, 270 feet per minute, and such arrangement also provides for reversing the elevator if desired to assist in unloading. With such an arrangement, the operator can slow the elevator down to around 50 feet per minute chain speed, for example, and load rocks efficiently if the scraper is moving forward slowly, and still receive full speed and power from the engine for the elevator drive. Motor 42 is supplied with pressurized fluid from a suitable source such as the pump driven by the engine for the vehicle through a pressure line 44. A discharge line 46 is provided to discharge fluid from the motor back to the hydraulic system and a drain line 48 also is provided.

The sprockets 38 drive a pair of endless chains 50 which are trained over the sprockets and also over a pair of idlers 52 at the upper end of the elevator mechanism, the idlers 52 preferably being smooth, that is, not having teeth to mesh with the chains. The idlers 52 are adjustably mounted at the upper extremities of the frame members 36. The tension on the chains can be adjusted by means of the adjusting screws 54.

Extending between the two chains 50 are a plurality of flights or drags 56 at regularly spaced intervals along the chains and at right angles thereto. During loading operation the chains revolve counterclockwise (the direction of the arrow 58 indicated in FIG. 2) and the flights 56 sequentially engage the earth and loosen it and then pull it up and away from the cutting edge 26 of the scraper and back into the bowl 24. During such operation, the sprocket wheels 38 transfer force directly through the intervening chains 50 to the flights 56 which are in engagement with the earth during the loosening operation as well as the first part of the dragging operation to get the earth back into the bowl.

Such arrangement and operation has been found to reduce greatly the weight and strength of the frame required to support the elevator mechanism and also to reduce wear on the chains, sprockets and other parts. In addition, the elevator mechanism disclosed herein has been found to load much more efficiently than a conventional elevator mechanism.

As a specific example of the improvement provided by the elevator mechanism disclosed herein, in a typical 11 cubic yard capacity elevating scraper, it was found that the weight of the elevator mechanism could be reduced from approximately 3500 pounds for a conventional mechanism to approximately 2500 pounds when the present invention is used. Using the same comparison of elevators, with everything else the same, as nearly as possible, including the material being loaded, it has been found that it is possible to load a scraper with the elevator of the present invention in approximately 40–45 seconds, as compared to 70–90 seconds for the conventional elevator construction.

Figure 4:
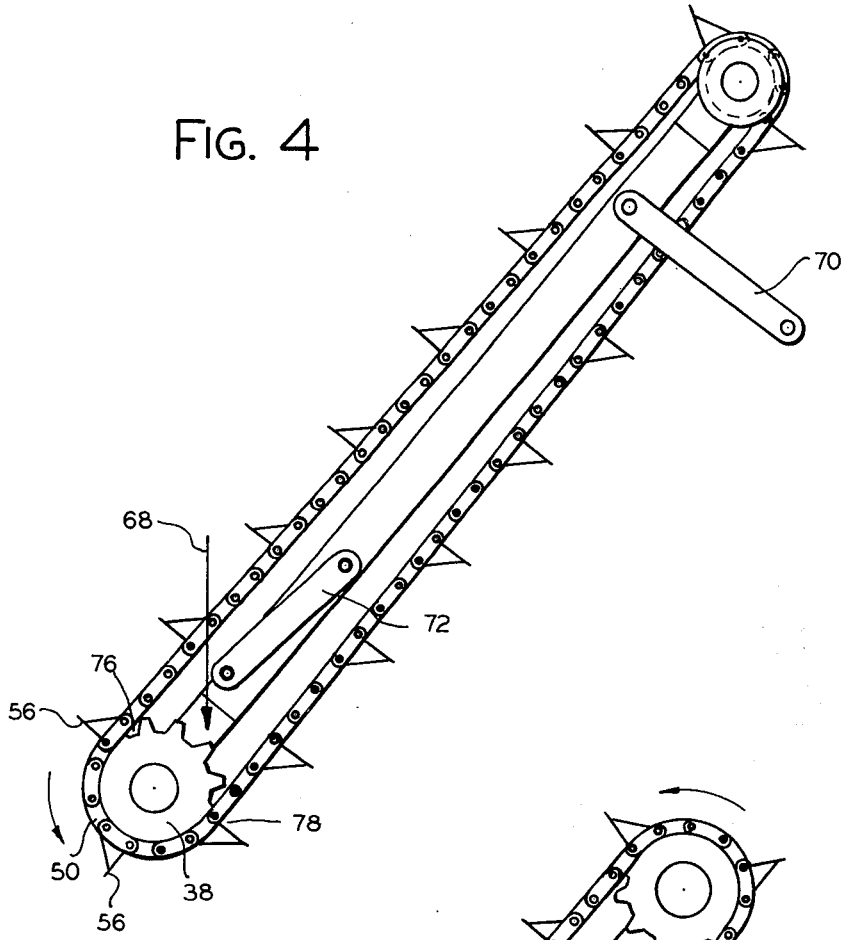
FIG. 4 is a schematic view of the elevator mechanism of the present invention.
Figure 5:
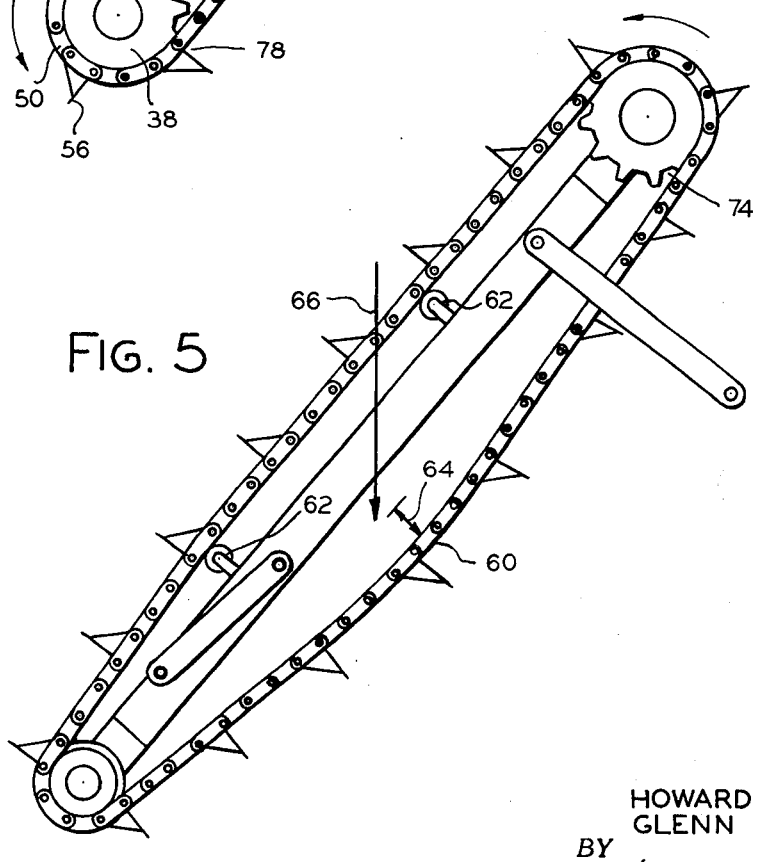
FIG. 5 is a schematic view of a prior art elevator mechanism.

FIGS. 4 and 5 which show respectively schematic views of the key parts of the invention of the present mechanism and the corresponding parts of a prior art elevator mechanism, emphasize the differences of the two structures and the advantages of the present invention. Referring first to FIG. 5, it has been found that it is necessary in the conventional elevator mechanism to have considerable slack in the chains, and this is illustrated by the sag in the chain illustrated at 60, and also by the pair of intermediate idlers 62 which it is customary to utilize with a conventional elevator mechanism in order to keep the upper length of each chain from dragging on the frame. In this connection, it may be mentioned that it has been customary in the prior art elevator mechanisms to have the chains inside the longitudinal frame members, respectively, and also to use cross braces to strengthen the frame, and as a result, if there is slack in the chains, it is necessary to use idlers to prevent the chains from contacting the frame. See, for example, U.S. Pat. No. 3,444,750, and particularly FIG. 2 of the drawing of such patent for an illustration of one form of prior art elevator construction.

It has been found necessary to have considerable slack in the chains of conventional elevator mechanisms in which the driving sprockets are at the upper end as illustrated in FIG. 5, and one reason for this is because the force which operates the chains is applied by the sprockets at the upper end, but the principal resistance, and particularly the shock or transient loads occur at the other end. During operation of such a conventional elevator mechanism, each time a flight engages the ground and begins to dig into it, the effect is to tend to elongate the lower length of the chains between the lower idler and the upper driving sprocket. Because of the resulting interaction of the chain with the lower idler and the upper driving sprocket, it has been found necessary to have considerable slack in the chain of a conventional elevator and also to make adjustments frequently to keep the slack the proper amount. As a example, referring to FIG. 5, in a typical case of a relatively small 11 cubic yard scraper, as mentioned previously, the amount of slack in the chains will permit a movement of 4 to 5 inches in the space indicated by the arrow 64 as the bowl fills with dirt and the chains ride up over such dirt.

In contrast to the prior art, the elevator mechanism of the present invention operates with the chains under a slight tension at all times and, as illustrated in FIG. 4, no idlers are needed for the upper portion of the chains and there is no significant slack in the bottom portions of the chains. It will be understood that in view of the fact that the chains are located outside the longitudinal frame members, in the present invention, that idlers to support the upper chain portions might not be required even if there were slack in the chains, but in any event, there is no such slack.

Another advantage of the construction of the present invention over the conventional construction is that the center of gravity of the elevator mechanism is moved toward the lower end which is desirable. Such change in location is illustrated by the vertical arrows 66 in FIG. 5 and 68 in FIG. 4. The reason the center of gravity of the construction of FIG. 4 is near the bottom end is because the drive motor is located near the bottom end as compared to prior art elevator mechanisms such as are shown, for example, in the previously mentioned U.S. Pat. No. 3,444,750 and also in U.S. Pat. No. 3,483,639. In both of these patents, the drive motor is located near the top and consequently the center of gravity is nearer the top, as illustrated by the line 66 in FIG. 5.

It is important to have a means for holding down the lower end of the elevator mechanism during operation because it will be understood that when operating in some kinds of soils or when rocks are encountered, that the lower end moves upwardly somewhat to counteract the abnormal forces encountered or to permit the passage of rocks into the scraper which otherwise would not be able to pass between the elevator mechanism and the cutting edge. Various devices, including springs, for example, have been utilized to hold the lower end of the elevator adjacent the ground during operation, but at the same time, permit it to move upwardly when necessary, but it will be appreciated that a gravity force utilizing the weight of the elevator mechanism itself to produce the downward force is a simple and inexpensive arrangement. The use of various gravity arrangements for this purpose is known, and the presently disclosed construction shows upper links 70 and lower links 72 by which the elevator mechanism is pivotally connected to the bowl portion of the scraper to permit the elevator mechanism to rise as necessary, but return to its lowered position again by gravity as soon as conditions permit.

Another advantage of the present construction with the idlers at the top instead of the bottom is that the tendency of dirt, rocks and other debris to enter the sprockets is minimized. It will be appreciated from FIG. 5 that it is likely that such materials may be carried upwardly on the upper surface of the chains and be caught between the chain and the sprocket at location 74. In the present invention, however, in which the chain engages the sprocket at the top thereof, namely, at the location 76, it will be appreciated that any dirt, rocks or other deleterious material which may have been on the chain will likely have fallen off before it reaches the sprocket, and in any event, is not likely to be on the under surface of the chains.

As mentioned previously, the digging force is transmitted directly from the sprocket 38 through the chain 50 to the flights 56. By the time the flights have reached the position indicated by the numeral 78, the digging portion of the cycle will be completed and thereafter the flights will have a relatively steady load of pulling dirt back and up into the bowl and, therefore, the tension on the lower portion of the chains will be a steady load, with no shock load component, as in the prior art.

It will be appreciated that while the scraper vehicle is illustrated in FIG. 1 in a loading position in which the cutting edge 26 and the flights 56 of the elevator are in contact with the soil or other material being loaded, that after the loading operation has been accomplished, the bowl portion is raised by contracting actuators 25 to lift the cutting edge and the bottom portion of the elevator away from the ground for transport. Also, while mention has been made herein of loading various types of soil and rocks, it will be appreciated that the elevator of the invention described and illustrated herein can load a great variety of material including sand, clay, other types of soil, rocks, various loose materials, and the like.

It will be appreciated also that the construction of the present elevator mechanism in which the chains are located outside the side frame members 36 makes it possible to extend the flights 56 closely adjacent the sides of the bowl 24 of the scraper, and this is illustrated in FIG. 3 in which fragmentary portions of the sides of the bowl 24 are shown, with the links 72 pivoted thereon at locations 25, respectively. As compared to the prior art constructions, in which the chains are located inside the side frame members of the elevator, the projection of the flights outwardly beyond the chains is reduced and this reduces the bending forces to which the flights are subjected during operation with the result that it is possible to use lighter weight and less expensive material for the flights 56.

While we have described and illustrated herein a preferred mode for carrying out our invention as prescribed by the statute, it will be appreciated by those skilled in the art that modifications may be made. Accordingly, we intend to cover by the appended claims all such modifications which fall within the true spirit and scope of the following claims.

We claim:

1. A mobile earth-moving scraper having an earth material receiving space defined on at least three sides by wall and floor members leaving an open front, a forwardly and downwardly inclined scraper blade extending transversely of the space and carried by said members at said open front and discharging into said space, an inclined endless scraper-type elevator mounted between said wall members, elevator mounting means yieldably supporting the elevator permitting it to rise and fall as a unit of mass substantially isolated from the remaining scraper mass, said elevator unit of mass comprising a pair of endless chains, flights connected between said chains for contacting the dirt and pulling it into the space behind the blade, a pair of idlers located remotely from the blade over which the respective endless chains operate, a pair of driving sprockets for driving the respective chains located adjacent the blade and elevator drive means connected to the drive sprockets contributing substantial mass to the elevator unit of mass below the transverse centerline of the elevator such that the center of gravity of the elevator unit of mass is below the centerline.

2. A mobile earth-moving scraper according to claim 1 in which the driving sprockets are coaxial.

3. A mobile earth-moving scraper according to claim 2 in which there is provided an elevator frame, said elevator drive means being carried at the lower end of said frame and rotatably mounting said driving sprockets.

4. A mobile earth-moving scraper according to claim 3 in which said elevator frame includes a pair of side frame members spaced inwardly of the scraper wall members, said idlers being rotatably supported at the upper ends of said side frame members.

5. A mobile earth-moving scraper according to claim 4 in which the elevator drive means includes a tubular housing secured at the lower end of the frame, said housing extending beyond the side frame members, a shaft rotatably housed within said tubular housing and planetary hubs housing gear reduction means at each end of said housing drivenly connected to said shaft and the sprockets being mounted circumjacent said hubs.

6. A mobile earth-moving scraper according to claim 5 wherein a variable speed motor is mounted on the housing, said motor being carried in an upwardly disposed manner between the upper and lower paths of said flights.

7. A mobile earth-moving scraper according to claim 6 in which said elevator mounting means includes a pair of links, one on each side pivotally mounted to the scraper side wall members on one end and extending laterally inwardly pivotally mounting on the elevator side frame members at the other end, said links pivoting in unison as the elevator rises and falls.

8. In an elevating scraper having a bowl, ground-engaging wheels supporting the bowl, a tractor for pulling the scraper, the bowl having spaced side walls closed at the bottom by a floor and at the rear by an end wall and being opened at the front, a scraper blade inclined downwardly and forwardly at the front adapted to be lowered into engagement with the ground during loading operations, an elevator including an elevator frame pivotally mounted near its upper end at the front of the bowl so as to rise or fall in relation to the blade according to loading conditions, the improvement comprising an elevator drive mounted at the lower end of said frame and spaced from said pivotal mounting substantially the full length of the elevator frame whereby the elevator loading action is increased.

9. The improvement according to claim 8 wherein a pair of links, one on each side, is pivotally connected on one end to the side walls of the bowl and pivotally connect on the opposite ends to the elevator frame adjacent its upper end.

10. The improvement according to claim 9 wherein a second pair of links is pivotally connected, one on each side, between the bowl and elevator frame adjacent the lower end and together with the upper links, guide the elevator movements.

11. The improvement according to claim 9 wherein the elevator frame includes a tubular cross member at the lower end having an enlarged hollow center portion, an hydraulic motor mounted on said center portion, gearing means housed within said center portion driven by said motor and dividing the output thereof axially along said tubular cross member, shafts transmitting said outputs, planetary hubs rotatably mounted at each end of said cross member receiving the output of said shafts, and said elevator sprockets mounted on said hubs.

12. The improvement according to claim 11 wherein hydraulic lines filled with hydraulic fluid are connected to said motor and extend generally upwardly along said elevator frame and flexible hose lines connect to said hydraulic lines adjacent the upper pivotal mounting location of the frame, said flexible hose lines being connected on the other end with a source of hydraulic pressure for operating said motor.

13. A scraper elevator for use on a mobile earth-moving scraper having a bowl defined by side walls, a floor and an end wall being opened at the front to receive said elevator, a scraper blade extending across the front mounted between the side walls beneath the elevator and discharging into the bowl, said elevator comprising a frame, a pair of drive sprockets rotatably mounted at the lower end of said frame, a pair of planetary hubs rotatably mounted at the lower end of said frame around which said sprockets are mounted, a pair of guide wheels rotatably mounted at the upper end of said frame, a pair of endless chains engaging said sprockets at the bottom and guided over said guide wheels at the top, a plurality of spaced, scraper-type flights connected between said chains, an elevator drive mounted adjacent the lower end of said frame and drivingly connected to said sprockets for driving said chains in unison such that during loading operations the flights will travel downwardly on the upper chain length, around the sprockets and in contact with the earth material approximately below the elevator drive and then move upwardly with the lower chain length to assist in moving the earth material off of the scraper blade and into the bowl, mounting means for said elevator permitting the elevator to rise and fall in relation to the blade, the elevator drive comprising a supported mass on said mounting means contributing a substantial portion of the elevator supported mass below the transverse centerline of the elevator such that the elevator has an increased downward moment enhancing the penetration of the flights into the earth material.

* * * * *